US005305569A

United States Patent [19]

Malmquist et al.

[11] Patent Number: 5,305,569

[45] Date of Patent: Apr. 26, 1994

[54] THICK SHINGLE

[75] Inventors: Alfred B. Malmquist, Rancho Rio, N. Mex.; Matti Kiik, Dallas, Tex.

[73] Assignee: Elk Corporation of Dallas, Dallas, Tex.

[21] Appl. No.: 977,887

[22] Filed: Nov. 18, 1992

Related U.S. Application Data

[63] Continuation-in-part of Ser. No. 609,731, Nov. 6, 1990, abandoned, which is a continuation-in-part of Ser. No. 340,259, Apr. 19, 1989, abandoned.

[51] Int. Cl.[5] ..... E04D 1/26; E04D 1/28

[52] U.S. Cl. ..... 52/309.8; 52/309.14; 52/314; 52/555; 52/558; 52/559; 52/560

[58] Field of Search ..... 52/560, 559, 558, 557, 52/555, 554, 518, 316, 311.2, 314, 309.1, 309.4, 309.8, 309.14; 156/604, 61

[56] References Cited

U.S. PATENT DOCUMENTS

| | | |
|---|---|---|
| 1,310,082 | 7/1919 | Hose . |
| 1,722,702 | 7/1929 | Kirschbraun et al. . |
| 1,756,989 | 5/1930 | Overbury . |
| 1,973,931 | 9/1934 | Robinson . |
| 2,009,617 | 7/1935 | Harshberger . |
| 2,099,131 | 11/1937 | Miller ..... 52/554 X |
| 2,101,589 | 12/1937 | MacLean . |
| 2,106,624 | 1/1938 | Ray . |
| 2,142,181 | 1/1939 | Croce . |
| 2,170,534 | 8/1939 | McNutt . |
| 2,356,570 | 8/1944 | Deuchler . |
| 2,705,209 | 3/1955 | Rowe . |
| 2,724,872 | 11/1955 | Herbes . |
| 2,863,405 | 12/1958 | Leibrook et al. . |
| 3,372,083 | 3/1968 | Evans et al. . |
| 3,467,572 | 9/1969 | Ahramjian . |
| 3,468,092 | 9/1969 | Chalmers . |
| 3,613,328 | 10/1971 | Morgan et al. . |
| 3,619,343 | 11/1971 | Freeman . |
| 3,624,975 | 12/1971 | Morgan et al. . |
| 3,731,449 | 5/1973 | Kephart, Jr. . |
| 3,852,934 | 12/1974 | Kirkhuff . |
| 3,921,358 | 11/1975 | Bettoli . |
| 4,019,938 | 4/1977 | Forrester . |
| 4,021,981 | 5/1977 | Van Wagoner . |
| 4,028,450 | 6/1977 | Gould . |
| 4,045,265 | 8/1977 | Tajima et al. . |
| 4,065,899 | 1/1978 | Kirkhuff . |
| 4,122,230 | 10/1978 | Lowell . |
| 4,137,198 | 1/1979 | Sachs . |
| 4,186,236 | 1/1980 | Heitmann . |
| 4,188,763 | 2/1980 | Thiis-Evensen . |
| 4,191,722 | 3/1980 | Gould . |
| 4,195,461 | 4/1980 | Thiis-Evensen . |
| 4,226,069 | 10/1980 | Hinds . |
| 4,268,572 | 5/1981 | Toland . |

(List continued on next page.)

FOREIGN PATENT DOCUMENTS

| | | |
|---|---|---|
| 0602248 | 7/1960 | Canada . |
| 0609501 | 7/1964 | Canada . |
| 0105177 | 8/1966 | Denmark . |

OTHER PUBLICATIONS

Bird & Son Asphalt Roofing Shingles Catalog, pp. Cover through 8.

Residential Asphalt Roofing Manual, 1988, Front & back covers, pp. i–60; Asphalt Roofing Manufacturers Association.

*Primary Examiner*—Carl D. Friedman
*Assistant Examiner*—Robert J. Canfield
*Attorney, Agent, or Firm*—Richards, Medlock & Andrews

[57] ABSTRACT

A series of roofing shingles (200, 240, 260, 280) are disclosed which have multiple tabs across the exposed width of the shingle. A polymer foam layer is bonded to an asphalt shingle material to form the roofing shingle. The polymer foam is thicker at certain of the tabs than others to provide a pleasing layered appearance to the roof. The tabs can also be varied in width and length relative to adjacent tabs.

11 Claims, 4 Drawing Sheets

U.S. PATENT DOCUMENTS 4,288,959 9/1981 Murdock .
4,374,687 2/1983 Yamamoto .
4,396,686 8/1983 Fiorio .
4,399,186 8/1983 Lauderback .
4,405,680 9/1983 Hansen .
4,434,589 3/1984 Freiborg .
4,465,792 8/1984 Carr et al. .
4,470,237 9/1984 Lincoln et al. .
4,521,478 6/1985 Hageman .
4,565,724 1/1976 Smits .
4,571,356 2/1986 White et al. .
4,572,865 2/1986 Gluck et al. .
4,599,258 7/1986 Hageman .
4,706,435 11/1987 Stewart .
4,717,614 1/1988 Bondoc et al. .
4,817,358 4/1989 Lincoln et al. .
5,181,361 1/1993 Hannah et al. ..... 52/554 X
5,232,530 8/1993 Malmquist et al. ..... 52/558 X FIG. 9
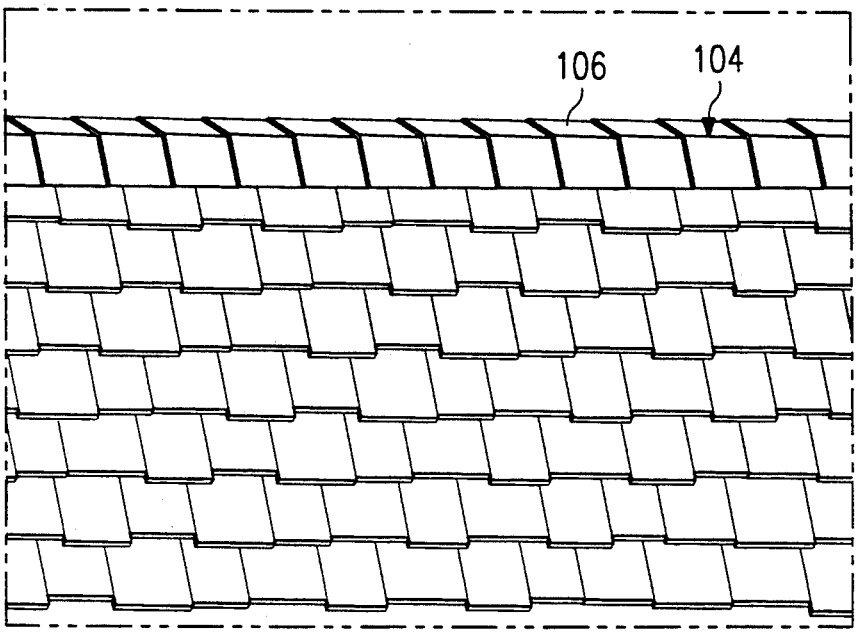
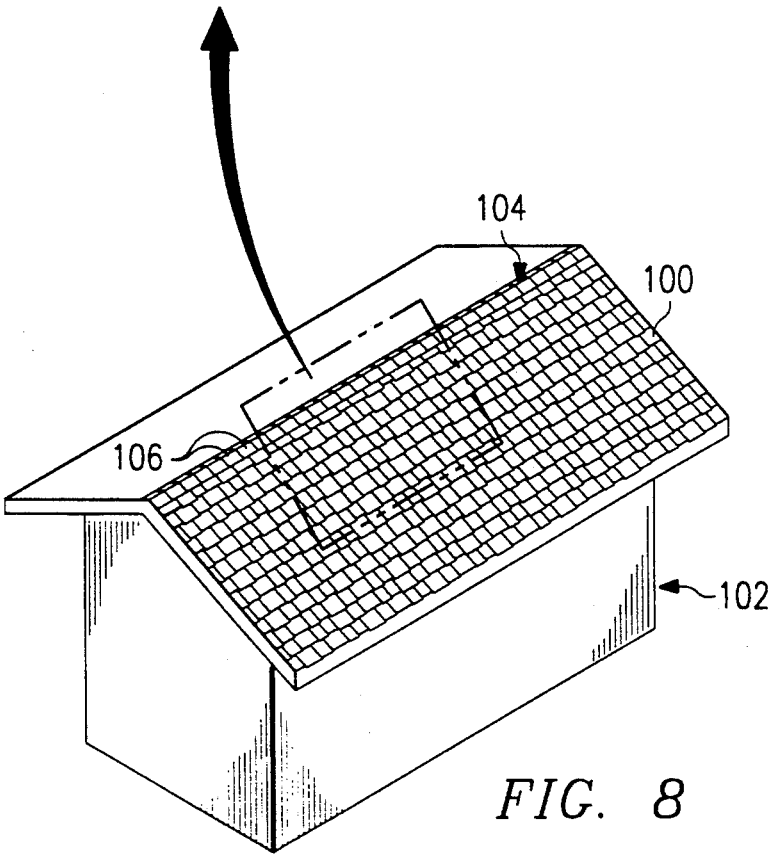
FIG. 8

THICK SHINGLE

CROSS REFERENCE TO RELATED APPLICATIONS

This application is a continuation-in-part of U.S. patent application Ser. No. 609,731 filed Nov. 6, 1990; now abandoned which is continuation-in-part of U.S. patent application Ser. No. 340,259, filed Apr. 19, 1989 now abandoned.

TECHNICAL FIELD

This invention relates to an improved roofing product, and in particular to a thickened conventional asphalt roofing shingle to enhance the appearance of a roof.

BACKGROUND of THE INVENTION

The vast majority of home roofing is done with either an asphalt composite shingle or a wood shingle. The composite shingle has significant cost, service life and flammability advantages over the wood shingle. However, the wood shingle is seen by many to be a much more desirable roofing material for aesthetic purposes.

One important aesthetic advantage of the wood shingle is its greater thickness relative to the composite shingle. Another advantage is the irregularity of the wood shingles. These features provide a pleasing layered look to the roof. While composite shingles could be made thicker, to compare in thickness with the wood shingle, the increase in weight would be unacceptable. Even so, it would be a significant advantage to combine the non-flammable, inexpensive features of the composite shingle with the attractive layering effect of the wooden shingle.

SUMMARY OF THE INVENTION

In accordance with one aspect of the present invention, an improved roofing shingle is provided. The roofing shingle includes a first layer of asphaltic roof material, the layer having a granule impregnated surface for exposure to the elements and an under side. The first layer has a number of tabs formed across its width. The shingle further includes a second layer of polymer foam material bonded to the under side of the first layer to effectively thicken the shingle and enhance the appearance of a roof using the shingle. The second layer has a different thickness on at least one of the tabs than the others.

In accordance with another aspect of the present invention, the polymer layer has a thickness which tapers from zero to $\frac{3}{4}$ inch. In accordance with another aspect of the present invention, the polymer foam is a urethane foam.

In accordance with yet another aspect of the present invention, a method is provided for forming a plurality of tabs on a sheet of conventional asphaltic shingle material and attaching a layer of polymer foam to the under side of the sheet of asphaltic shingle material. The thickness of the polymer foam on at least one of the tabs is different than on other tabs. In one aspect, the forming of the polymer foam includes a free blown spray process. In another aspect, a froth process is used. In another aspect, a free blown pour and mold process can be used. In a final aspect, a pre-foamed polymer can be adhered to the conventional asphaltic shingle material by flame adherence or adhesive adherence.

BRIEF DESCRIPTION OF THE DRAWINGS

For a more complete understanding of the present invention and the advantages thereof, reference is now made to the following description taken in conjunction with the accompanying drawings, in which:

FIG. 8 is a perspective view of the roof of a building using the roofing shingles of the present invention;

FIG. 9 is a perspective view in greater detail of a portion of the roof;

DETAILED DESCRIPTION

With reference now to the accompanying FIGURES and the following Detailed Description, the present invention provides an improved method of forming a roofing shingle and an improved roofing shingle which combines the advantages of the conventional asphalt composite roof shingle and the enhanced thickness of a wood shingle, as well as providing advantages not found in either a composite or wood shingle construction.

Figure 1:
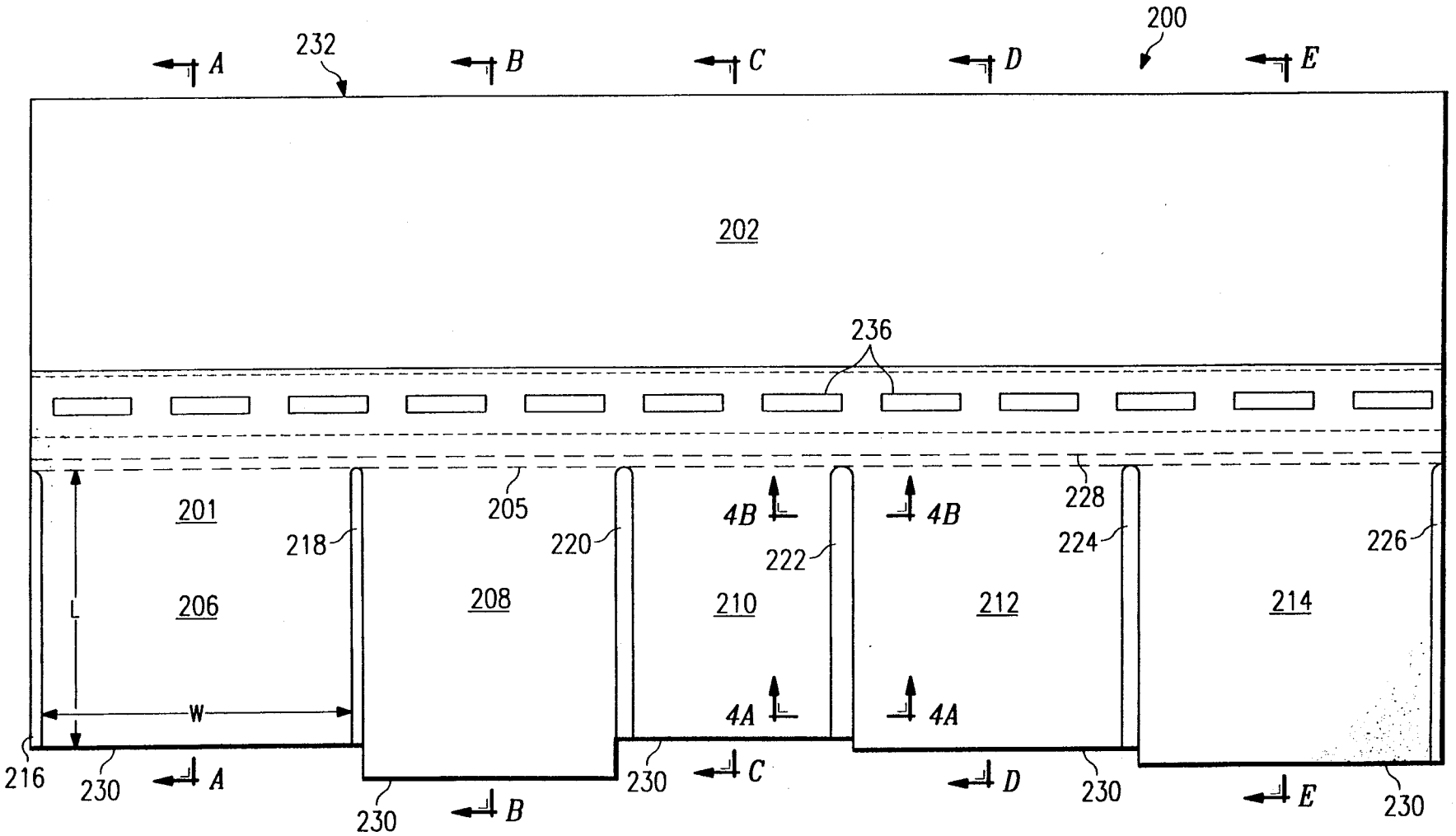
FIG. 1 is a plan view of a roofing shingle with tabs.

With reference now to FIGS. 1–7, a specific shingle design will be described. With reference to FIG. 1, a roofing shingle 200 is illustrated which is formed of an upper layer 202 of conventional asphalt composite shingle material, and a lower layer 204 formed of a foamed polymer, such as urethane.

By a conventional asphalt shingle material is meant a material which can be cut into conventional asphalt shingles. The material is formed of a lower layer of asphalt, an intermediate layer of a base made from a material selected from the group consisting of fiberglass and felt, an upper layer of asphalt, and a layer of weather resistant granules. The felt is usually impregnated with the asphalt of the upper and lower layers. The voids between the individual fibers of glass in the fiberglass are usually occupied by asphalt from the upper and lower layers, which also coats the fibers.

The granule impregnated upper surface 201 of layer 202 is exposed to the elements. The upper surface of layer 204 is bonded to the underside 203 of layer 202 to prevent the separation of the layers in service as will be discussed hereinafter. In use, the shingle 200 can be attached to the roof by conventional techniques, including roof nails or staples.

Generally, the use of a multi-layered roof shingle, having a polymer foam lower layer 204, provides significant advantages. Aesthetically, the increased thickness provides significant visual enhancement of the roof character because of the layering effect. The us of the polymer foam can also provide significant improvement in strength characteristics, including tear resistance, flexibility and cold temperature crack resistance. The foamed polymer can also provide a significant improvement in shingle thermal insulation properties and reduces acoustic noise transfer through the roof. Finally, the flexibility of the foam material is likely to absorb shocks from severe hail and storm damage which could damage conventional asphalt composite or wood shingles. The degree of improvement in these non-aesthetic characteristics is dependent upon the choice and formulation of the foamed polymer.

Conventional asphalt composite shingles are usually made in a hot asphalt coating process as a continuous sheet of composite material in a width appropriate to the coating equipment. The sheet is fed into a cutting device which cuts individual shingles from the sheet. The present invention contemplates the addition of the polymer foam layer 204 to the under side of a conventional sheet of asphalt composite material after it has been formed into sheet form, and either prior to or after its cutting into individual shingle pieces. However, it is preferred to cut the sheet into individual shingle pieces first, and then apply the foam layer. The method of application of the polymer foam to the asphalt composite sheet includes free blown spray, pour molding, and froth methods which form the foam on the composite sheet, or adhering a pre-formed foam by conventional flame or adhesive techniques.

Irrespective of the method of forming polymer foam layer 204, the layer 204 is sufficiently flexible to avoid detraction from the pliability of the conventional asphalt composite shingle material forming layer 202. The foam preferably has fire retardant (FR) properties to avoid propagation of under shingle fires or smoldering. The adhesion between the layers 202 and 204 should be sufficient to allow satisfactory line processing such as cutting the sheets into individual shingles and subsequent customer handling. The foam should also exhibit an appropriate dark color to blend into the roof line, or meet aesthetic color styling requirements, as certain edges of the foam are likely to be exposed. Finally, it is most desirable that the foam application methods be compatible with current composite shingle processing technology to utilize existing production lines.

A method of application of the polymer foam to the sheet of composite asphalt material is the free blown method. In this method, the foam, typically urethane, is sprayed on to the under side of the asphalt composite sheet by a metered mixer which mixes in a predetermined quantity of catalyst or initiator as the polymer is blown on to the composite sheet. The foam then develops and cures on the asphalt sheet.

Advantages of the free blown method include the simple adaptation of this method to current composite material production lines and the absence of any heat source required for curing the polymer foam.

Another suitable method of application of the polymer to the sheet of composite asphalt material is a pour and mold method. The shingle 200 can be prepared in either an open or closed mold by pouring a suitable quantity of urethane in a liquid state to cover the portion of layer 202 to be covered by layer 204 and permitting the material to foam and cure into the desired shape. The pour application in a mold provides an advantage over spray application by eliminating the need to use a freon blowing agent and the resultant environmental concerns of hydrofluorocarbon release. The mold process can be used with a closed mold with a hinged upper mold section moving into a precise orientation with a lower mold section to mold the material therebetween. An open mold can be used provided a mechanism is used to properly shape the material as it foams and cures.

In the froth method of application, the polymer is used in a water based system in which air is introduced into the latex polymer in a controlled manner to froth the polymer and the froth mixture is then metered onto the under side of the composite material sheet with a fixed clearance knife or doctor blade.

Advantages of the froth method include the wide variety of polymers which can be used, including acrylics, urethanes, rubbers, vinyl and almost any film forming resin in a water system. The density can be precisely controlled, as can the applied thickness or gauge because of the use of the fixed clearance knife or doctor blade. The wide choice of polymers could allow the selection of a material which does not require a prime coat for proper adhesion to the asphalt composite material sheet Finally, precision frothing equipment is commercially available from Oakes Machine Corporation, Gusmer and others.

Preformed foam sheets can be bonded to the composite material sheets to form the roofing shingles 200. Any suitable state of the art laminating technique can be employed to bind the two sheets together, including flaming or adhesive lamination. By using a preformed foam, the gauge and density is predictable, and the foam can be precolored as desired.

In one trial undertaken with the teachings of the present invention, the free blown method of foam application was undertaken with a two-part polymer foam system, including a prepolymer of methylene bis (phenyl isocyanate); also known as MDI, polyol or polyamine and Trichlorofluoromethane (Freon 11), mixed in a one-to-one ratio by weight or volume (densities are quite similar) with both components at a temperature of about 160° F. A foam system of this type is provided by K. J. Quinn & Company, Inc. of 137 Folly Mill Road, Seabrook, N.H. 03874, as their QC-4860A/B roofing membrane, identified by the trademark QThane. The uncured material is applied with a thickness about one quarter of the desired final thickness after curing.

Table I provides experimental results of performance criteria at five different positions on the roofing shingles made in the test. Also provided is an average of the five test results and a comparison to a test result for just the asphalt composite material part of the shingle. Test measurements were made in the machine direction (MD) corresponding to the direction of movement of the sheet prior to cutting into individual shingles and along the cross machine direction (CD) corresponding to the width direction of the sheet.

TABLE

| | (Grey) QUINN #1 | | (White) QUINN #2 | | (Grey) QUINN #3 | | (Grey) QUINN #4 | | (Black) QUINN #5 | | QUINN Average | | HIP & RIDGE (Control) | |
|---|---|---|---|---|---|---|---|---|---|---|---|---|---|---|
| | MD | CD | MD | CD | MD | CD | MD | CD | MD | CD | MD | CD | MD | CD |
| Tensile: | | | | | | | | | | | | | | |

TABLE-continued

| | (Grey) QUINN #1 | | (White) QUINN #2 | | (Grey) QUINN #3 | | (Grey) QUINN #4 | | (Black) QUINN #5 | | QUINN Average | | HIP & RIDGE (Control) | |
|---|---|---|---|---|---|---|---|---|---|---|---|---|---|---|
| | MD | CD | MD | CD | MD | CD | MD | CD | MD | CD | MD | CD | MD | CD |
| (lbs/1") | | | | | | | | | | | | | | |
| 30° F. | 29 | 34 | 100+ | 100+ | 43 | 55 | 41 | 48 | 48 | 50 | 52.2+ | 60.4+ | 39 | 13 |
| 77° F. | 37 | 67 | 100+ | 68 | 41 | 55 | 59 | 66 | 72 | 47 | 61.8+ | 60.6 | 30 | 18 |
| 120° F. | 35 | 54 | 100+ | 100+ | 47 | 42 | 40 | 50 | 33 | 19 | 51.0+ | 53.0+ | 30 | 14 |
| Elongation: (1%) | | | | | | | | | | | | | | |
| 30° F. | 433 | 450+ | 465+ | 460+ | 454+ | 458+ | 415 | 466+ | 476+ | 471+ | 448.6+ | 461.0+ | — | — |
| 77° F. | 467+ | 426+ | 472+ | 468 | 388 | 485+ | 431+ | 467+ | 467 | 469 | 445.0+ | 463.0+ | — | — |
| 120° F. | 365+ | 411+ | 700+ | 683+ | 371 | 521+ | 335 | 452 | 319 | 471+ | 418.0+ | 507.6+ | — | — |
| Foam Adhesion: (lbs/1") | | | | | | | | | | | | | | |
| 30° F. | 2.50 | 1.13 | 0.50 | 0.63 | 1.00 | 1.00 | 1.00 | 0.90 | 1.00 | 1.17 | 1.20 | 0.97 | — | — |
| 77° F. | 4.00 | 1.13 | 3.50 | 1.50 | 3.00 | 2.00 | 2.50 | 1.00 | 3.00 | 1.00 | 3.20 | 1.33 | — | — |
| *77° F. (aged) | 0.50 | 0.50 | 0.75 | 0.33 | 0.75 | 0.50 | 0.50 | 0.45 | 0.50 | 0.50 | 0.60 | 0.46 | — | — |
| 120° F. | 2.75 | 0.50 | 2.50 | 0.25 | 1.75 | 1.50 | 1.50 | 0.33 | 2.25 | 0.50 | 2.10 | 0.62 | — | — |
| Tongue Tear: (lbs) | | | | | | | | | | | | | | |
| 30° F. | 18 | 15 | 31 | 25 | 19 | 14 | 20 | 23 | 20 | 26 | 21.6 | 20.6 | 2.6 | 2.2 |
| 77° F. | 11 | 19 | 30 | 26 | 22 | 24 | 28 | 19 | 15 | 24 | 21.2 | 22.4 | 2.7 | 3.3 |
| 120° F. | 16 | 11 | 26 | 22 | 12 | 14 | 15 | 19 | 17 | 26 | 17.2 | 18.4 | 1.6 | 2.8 |
| Staple Pull: (lbs) | | | | | | | | | | | | | | |
| 30° F. | 75 | | 100+ | | 100+ | | 65 | | 73 | | 82.6+ | | 52 | |
| 77° F. | 62 | | 70 | | 87 | | 84 | | 90 | | 78.6 | | 26 | |
| 120° F. | 65 | | 67 | | 60 | | 70 | | 75 | | 67.4 | | 27 | |
| **Mandrel: (2") | up/dn | up/dn | up/dn | up/dn | up/dn | up/dn | up/dn | up/dn | up/dn | | up/dn | | up/dn | up/dn |
| 30° F. | P/P | P/F | P/F | P/P | P/F | P/P | P/F | P/F | P/P | | P/F | | P/F | P/F |
| 77° F. | P/P | P/P | P/P | P/P | P/P | P/P | P/P | P/P | P/P | | P/P | | P/P | P/P |
| 120° F. | P/P | P/P | P/P | P/P | P/P | P/P | P/P | P/P | P/P | | P/P | | P/P | P/P |
| Stiffness: (Cantilever) | | | | | | | | | | | | | | |
| 30° F. | 15+/15+ | = | = | = | = | = | = | = | = | | = | | 11.0/11.5 | 10.25/11.0 |
| 77° F. | 15+/15+ | = | = | = | = | = | = | = | = | | = | | 8.25/9.25 | 7.5/9.0 |
| 120° F. | 15+/15+ | = | = | = | = | = | = | = | = | | = | | 5.75/6.5 | 5.5/6.25 |
| U.L. Seal Test: | Very Good | | Excellent | | Excellent | | Good | | Very Good | | | | Excellent | |
| Total Weight (Lbs/Sq.) | 110.3 | | 107.5 | | 115.0 | | 115.3 | | 128.6 | | | | Target 68 (?) | |
| Foam Weight (Lbs/Sq.) | 34.3 | | 34.6 | | 34.6 | | 37.0 | | 54.0 | | | | — | |
| Total Gauge (inches) | 5/16 | | 3/16 | | 3/16 | | ¼ | | 3/16 | | | | — | |
| Foam Gauge (inches) | ¼ | | ⅛ | | ¼ | | 3/16 | | ⅛ | | | | — | |

*5 hrs. in 115° F. Water

**up = granule surface exposed: dn = foam [back] surface exposed: P = passed [no cracking]: F = failed [surface cracked]

The tensile strength tests are conducted in accordance with ASTM Standard D-751. Preferably, the shingle should exhibit adhesive strength of the bond between the upper and lower layers sufficient to prevent separation during manufacture and in field handling and service under normal circumstances.

In addition to the tongue tear test undertaken, Elmendorf and Trapazoid tear tests could be employed as well. In any event, the construction must be sufficiently pliable and tear resistant to withstand normal handling and installation practices in the roofing industry.

In summary, the test results indicate that the roofing shingle constructed in accordance with the present invention provides significant increases in the tensile strength, tear strength and staple pull resistance as compared to conventional composite shingles. The cantilever stiffness test indicates that the shingle 200 exhibits an initial higher degree of stiffness and tends to remain relatively unchanged over a wide temperature range as compared to a standard shingle.

A wind tunnel test was also conducted on a test roof having the subject shingles. The roof deck was conditioned at 140° F. for sixteen hours prior to the testing. The test was conducted at wind speeds of 60 mph for two hours and at 100 mph for ten minutes. No failure was evidenced.

The roofing shingle 200 is formed into a specific shape to enhance the appearance of a roof. The shingle has five tabs (or shake sections), tabs 206–214, across the width of the shingle. The tabs will be exposed when the shingle is installed on a roof. Each tab has a different width W, a different length L and a different thickness of foamed polymer bonded thereto which combine to form a pleasing appearance.

To form the tabs, the upper layer 202 has key ways 216–226 cut through the layer which extend from the exposed edge (butt end) of each tab to a line 205.

Figure 2:
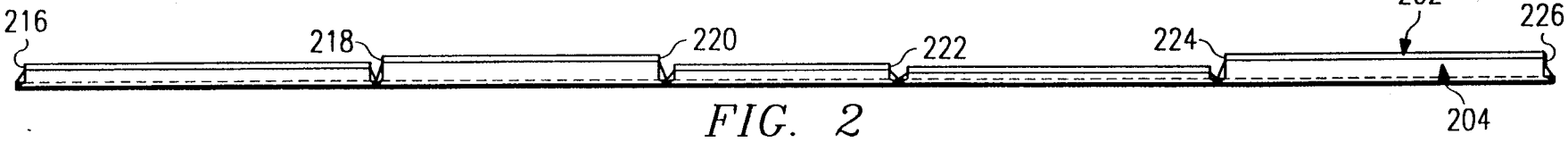
FIG. 2 is a front view of the roofing shingle.
Figure 4A:
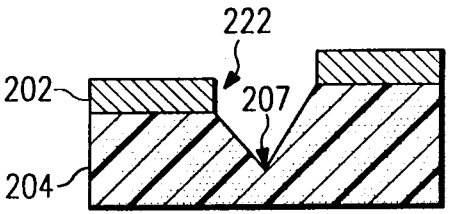
FIGS. 4A—B are detail views of the key way in the shingle at the leading edge and back edge of the key way.
Figure 4B:
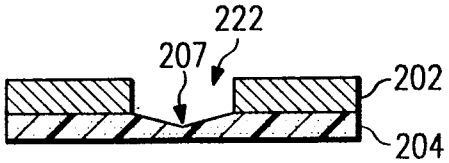
Figure 3A:
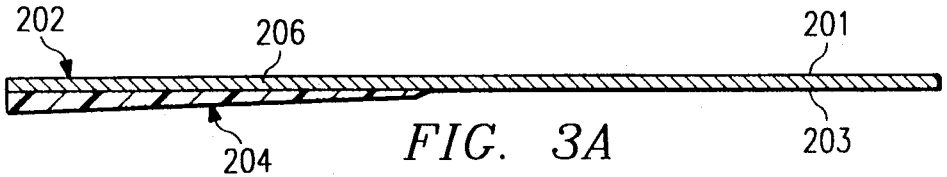
FIGS. 3A-E are cross-sectional views of the roofing shingle of FIG. 1 taken along lines A—A through E—E, respectively.
Figure 3B:
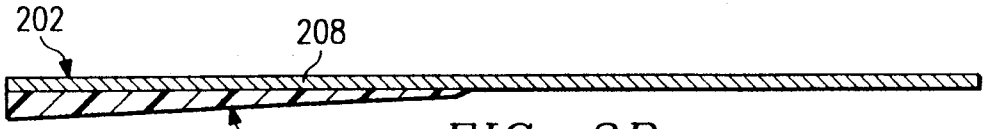
Figure 3C:
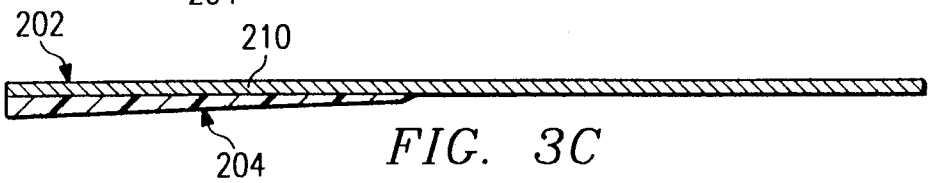
Figure 3D:
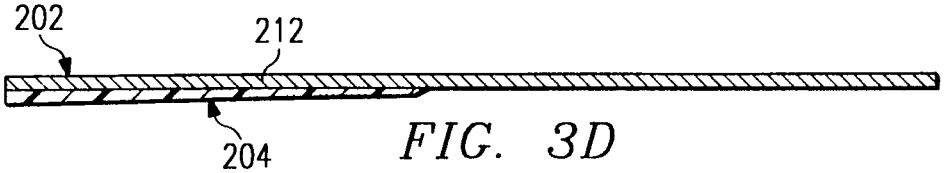
Figure 3E:
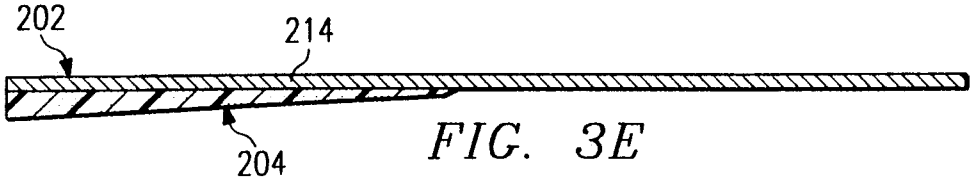

The foamed polymer layer is applied to the upper layer 202 with a taper, as best seen in FIGS. 3A–E. The foamed layer is preferably begun at line 228, about ¼" above the line 205, and increases in thickness to the exposed edge of the tabs. Each key way is continued somewhat into the underlying foam layer 204, but not through the foam layer, as seen in FIGS. 2 and 4A–B. The lower layer 204 is formed with a trough 207 at each key way as seen in FIGS. 4A and 4B. The lower layer 204 for each tab is provided with a different thickness over its length, tapering from zero thickness along line 228 to its maximum thickness at the exposed edge 230 of each tab.

In one shingle constructed in accordance with the teachings of the present invention, the width of the tabs from left to right in FIG. 1 was eight inches, six and one-half inches, five inches, seven inches and seven and one-half inches. The width of each of the key ways from left to right was one-quarter inch, one-quarter inch, three-eighths inch, one-half inch, three-eighths inch, and one-quarter inch. The distance between the back edge 232 of the shingle and each exposed edge of a tab, from left to right, is 16¾ inches, 17½ inches, 16½ inches, 16¾ inches, and 17¼ inch. The distance from the back edge to line 228 is nine and one-quarter inches. The thickness of the tab and lower layer 204 on each tab at its exposed edge, from left to right, is nine-sixteenths inch, eleven-sixteenths inch, nine-sixteenths inch, seven-sixteenths inch, and eleven-sixteenths inch. The shingle was 36 inches wide. A release tape line (not illustrated) can be formed on the underside of the shingle. An adhesive line 236 can be formed on the upper side of the shingle which is covered by the release line on the shingle stacked above it. The overlaying shingles would be placed so that no underlying shingle above line 205 is exposed.

Figure 5:
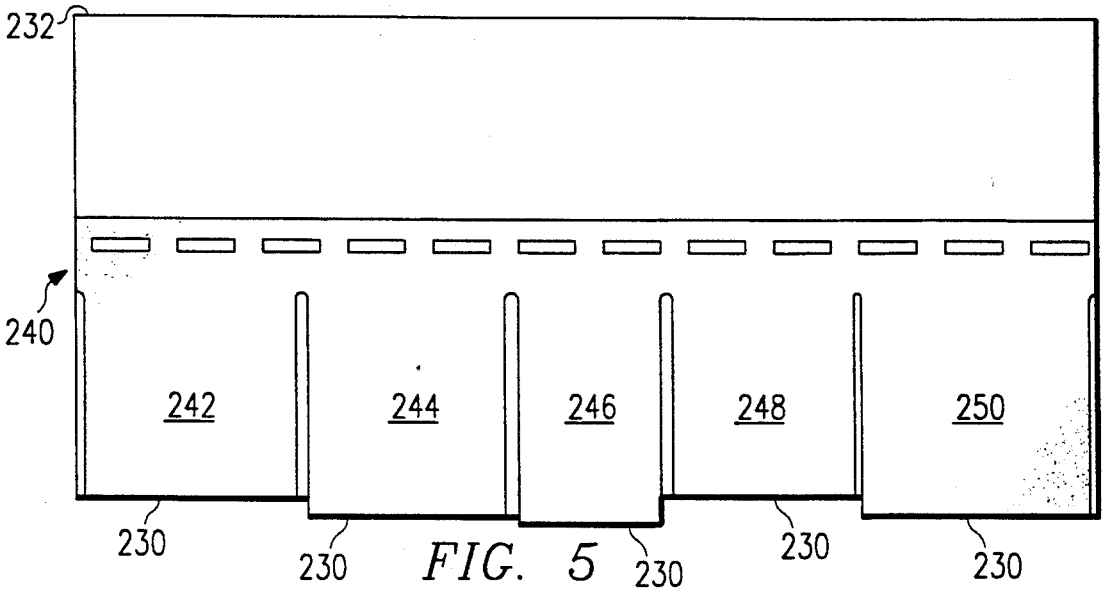
FIG. 5 is a plan view of a second roofing shingle with tabs.

FIG. 5 illustrates a roofing shingle 240 which is identical to shingle 200 in certain aspects, designated by 5 same reference numeral, but is formed with tabs 242–250. The width, length and thickness of each of the tabs 242–250 will be different than the tabs on roofing shingle 200. Shingle 240 is intended to be placed next to shingle 200 on the roof so that the variety of tab constructions will provide a pleasing appearance. As can be seen from the drawings when the shingle 240 is installed next to the shingle 200, the rightmost key way of shingle 200 will combine with the leftmost key way of shingle 240 to form a single key way with a width that is the sum of the combining key ways. In one shingle constructed in accordance with the teachings of the present invention, shingle 240 had tabs of width from left to right of seven and one-half inches, seven inches, five inches, six and one-half inches and eight inches. The width of the key ways between the tabs, from left to right, are one-quarter inch, three-eighths inch, one-half inch, three-eighths inch, one-quarter inch, and one-quarter inch. The length from the back edge 232 of the shingle to the exposed edge of the tabs, from left to right, is 16¾ inches, 17¼ inches, 17½ inches, 16½ inches, and 17¼ inches. The thickness of each tab at the exposed edge including the foamed polymer layer, from left to right, is seven-sixteenths inch, eleven-sixteenths inch, nine-sixteenths inch, nine-sixteenths inch, and eleven-sixteenths inch.

Figure 6:
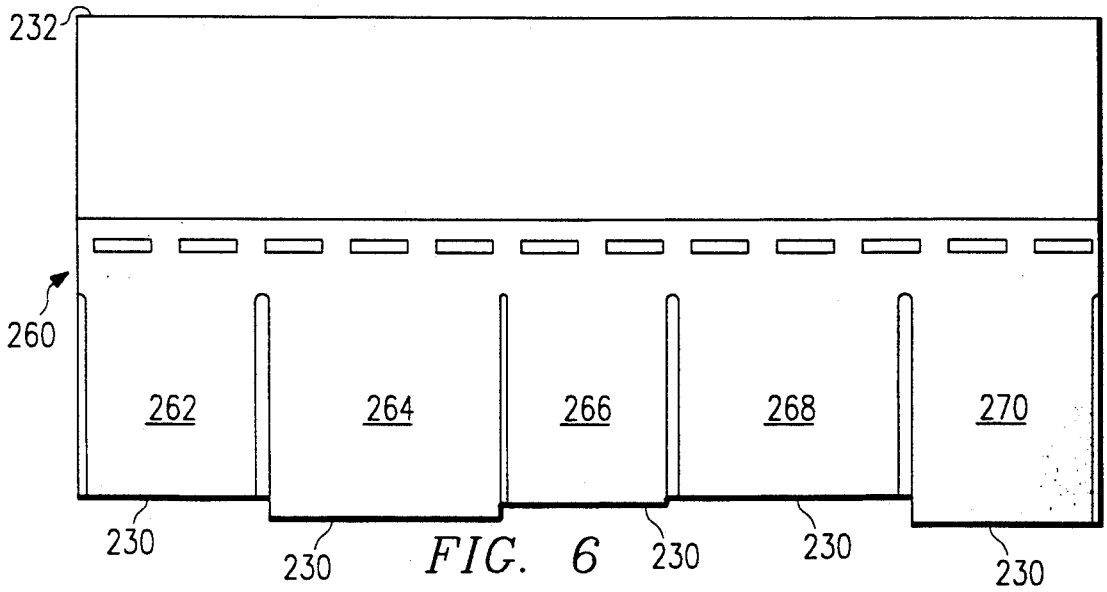
FIG. 6 is a plan view of a third roofing shingle with tabs.

With reference now to FIG. 6, a roofing shingle 260 is illustrated which has elements common to shingles 200 and 240 which are identified by identical reference numerals. The tabs 262–270 are each also of different length, width and thickness than the tabs on shingles 200 and 240. Shingle 260 is designed to be placed adjacent to shingle 240 in installing a roof.

In one shingle 260 constructed in accordance with the teachings of the present invention, the width of the tabs from left to right is six inches, eight inches, five and five-eighths inches, seven and three-quarters inches and six and one-half inches. The width of the key ways from left to right is one-quarter inch, one-half inch, one-quarter inch, three-eighths inch, one-half inch, and one-quarter inch. The distance from the back edge 232 to the exposed edge of each tab, from left to right, is 16½ inches, 17¼ inches, 16¾ inches, 16½ inches, and 17½ inches. The thickness of the exposed edge of each shingle, from left to right, is one-half inch, one-half inch, five-eighths inch, one-half inch, and three-quarter inch.

Figure 7:
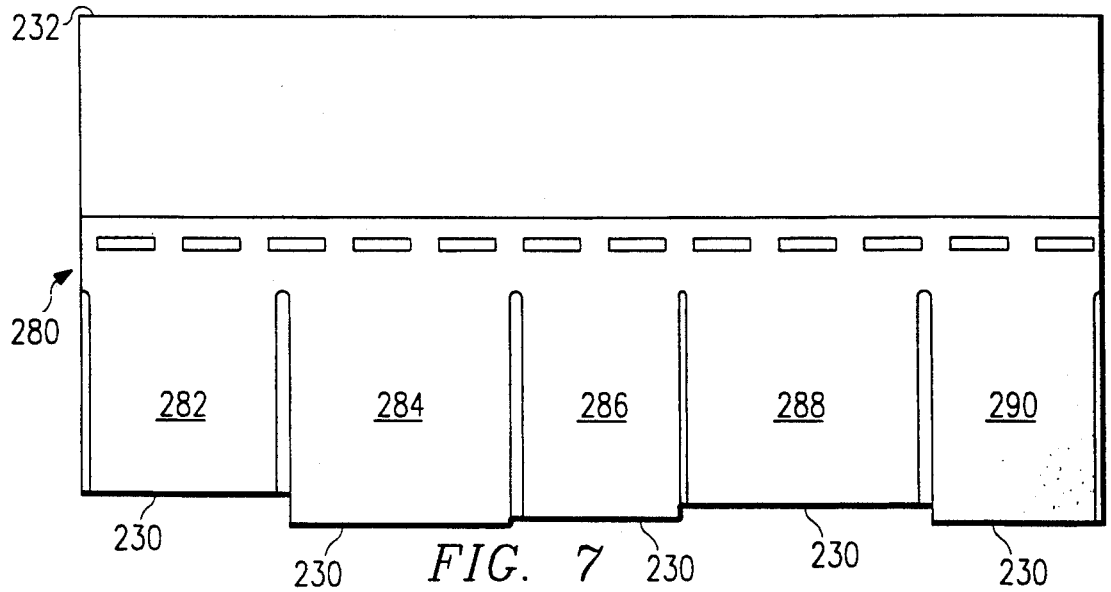
FIG. 7 is a plan view of a fourth roofing shingle with tabs.

With reference to FIG. 7, a roofing shingle 280 is illustrated which again is identical in many aspects to the shingles 200, 240 and 260 with those elements identified by identical reference numerals. Again, shingle 280 has tabs 282–290 which have a distribution of width, thickness and height dimensions different than the tabs on the other shingles. Shingle 280 would be intended to be positioned adjacent shingle 260.

In one shingle 280 constructed in accordance with the teachings of the present invention, the tabs had a width, from left to right, of six and one-half inch, seven and three-quarters inch, five and five-eighths inch, eight inch, and six inch. The key way width, from left to right, was one-quarter inch, one-half inch, three-eighths inch, one-quarter inch, one-half inch, and one-quarter inch. The length from the back edge 232 to the exposed edge of each tab, from left to right, was 16½ inches, 17½ inches, 17¼ inches, 16¾ inches, and 17½ inches. The thickness of the exposed edge 230 of each tab, from left to right, was nine-sixteenths inch, seven-sixteenths inch, eleven-sixteenths inch, nine-sixteenths inch, and eleven-sixteenths inch.

The shingles 200, 240, 260 and 280 are manufactured and packaged in bundles in sequence. Therefore, a roofer will first install a shingle 200, a shingle 240 next to it, a shingle 260 next to shingle 240 and a shingle 280 next to shingle 260. This pattern will be repeated as the roof is installed and will result in a aesthetic, custom appearing roof. The variation in tab thickness, width and height will appear to be random and therefore give the appearance of a roof of wooden shingles.

While the four shingle configurations are those selected as most preferable for aesthetic purposes, other shingle configurations are possible. It is preferred to vary the length of tabs exposed in the range from seven to eight inches, the width of the tabs from five to eight inches and the thickness of the tab and foam at the exposed edge between one-half to three-quarters inch.

FIGS. 8 AND 9 illustrate the application of roofing shingles 200, 240, 260 and 280 to the roof 100 of a structure 102. The ridge line 104 of the roof is covered by a hip and ridge shingle 106 which is made in a manner quite similar to the shingle 200. The hip and ridge shingle is also thickened to provide an enhanced appearance to the roof line and provide the other advantages discussed previously with shingles 200.

Although several embodiments of the invention have been illustrated in the accompanying drawings and described in the foregoing detailed description, it will be understood that the invention is not limited to the embodiments disclosed, but is capable of numerous rearrangements, modifications and substitutions of parts of elements without departing from the spirit and scope of the invention.

We claim:

1. A roofing shingle, comprising:

a weatherproof asphaltic composite material having a weatherproof side and an underside, the shingle of predetermined width, the material consisting of a lower layer of asphalt, an intermediate layer of a base made from a material selected from the group consisting of fiberglass and felt, an upper layer of asphalt and a layer of weather resistant granules, the material having at least one key way formed there define a plurality of tabs across the width of the shingle, each tab defining an exposed edge;

a foam layer bonded to the underside of the material, the foam layer having a thickness decreasing from the exposed edges of the tabs toward a back edge of the material, the foam layer having a different thickness at the exposed edge of a first tab then at the exposed edge of a second tab.

2. The shingle of claim 1 having five tabs across the width of the shingle, each of said tabs having a different width.

3. The shingle of claim 1 wherein the distance between the back edge of the material and the exposed edge of at least one tab is different than the distance between the back edge of the material and the exposed edge of another tab.

4. The shingle of claim 1 wherein the width of at least one tab is different than the width of another tab.

5. The shingle of claim 1 wherein the thickness of the tabs and of the foamed layer at the exposed edge of the tabs are within the range of $\frac{1}{2}$ to $\frac{3}{4}$ inches.

6. A roofing shingle, comprising:

a first layer of weatherproof asphaltic composite material having a weatherproof side and an underside, the material consisting of a lower layer of asphalt, an intermediate layer of a base made from a material selected from the group consisting of fiberglass and felt, an upper layer of asphalt and a layer of weather resistant granules, said material having an exposed portion defining a plurality of tabs across a width of the material, the width of each tab being different than the width of adjacent tabs, the length of each tab extending from a back edge to an exposed edge on each tab being different than the length of adjacent tabs;

a polymer foam layer bonded to the underside of the material in the exposed portion, the foam layer having a predetermined thickness at the exposed edge of each of the tabs, the predetermined thickness at the exposed edge of at least one of the tabs being different than the predetermined thickness of the foam layer at another of said tabs.

7. The roofing shingle of claim 6 wherein the foam layer is continuous.

8. The roofing shingle of claim 6 wherein the foam layer has a trough formed therein between each of the tabs.

9. The roofing shingle of claim 6 wherein the first layer defines key ways between adjacent tabs, the key ways varying in width across the width of the shingle.

10. The roofing shingle of claim 8 wherein the trough tapers from the exposed edge of the tab to said back edge.

11. A method for making a roofing shingle from a weatherproof asphaltic composite material having a weatherproof side and an underside, the material consisting of a lower layer of asphalt, an intermediate layer of a base made from a material selected from the group consisting of fiberglass and felt, an upper layer of asphalt and a layer of weather resistant granules, comprising the steps of:

forming a plurality of tabs across the width of the material in an exposed portion;

bonding a continuous layer of flexible polymer foam to the underside of the composite material within the exposed portion, the polymer foam having a thickness on a first of said tabs different that the thickness on another of said tabs.

* * * * *

UNITED STATES PATENT AND TRADEMARK OFFICE

CERTIFICATE OF CORRECTION

PATENT NO. : 5,305,569

DATED : April 26, 1994

INVENTOR(S) : Malmquist et al.

It is certified that error appears in the above-indentified patent and that said Letters Patent is hereby corrected as shown below:

Column 4, Detailed Description, line 17, insert a --.-- after the word --sheet--.

Column 7, line 38, delete the number --5-- and insert the word --the--.

Column 7, line 58, insert the words --of each-- after the word --edge--.

Signed and Sealed this

Eleventh Day of October, 1994

*Attest:*

*Attesting Officer*

Bruce Lehman

BRUCE LEHMAN

*Commissioner of Patents and Trademarks*